United States Patent [19]

Kolsky

[11] Patent Number: 5,034,998

[45] Date of Patent: Jul. 30, 1991

[54] PROTECTIVE DEVICE FOR REDUCING INJURY FROM FALLS

[75] Inventor: Rodger E. Kolsky, Schenectady, N.Y.

[73] Assignee: HPI Health Protection, Inc., Albany, N.Y.

[21] Appl. No.: 537,086

[22] Filed: Jun. 12, 1990

[51] Int. Cl.[5] ..... A41D 13/00

[52] U.S. Cl. ..... 2/2; 2/22; 2/92; 2/267

[58] Field of Search ..... 2/2, 267, 268, 22, 16, 2/92, 215, 23

[56] References Cited

U.S. PATENT DOCUMENTS

| | | | |
|---|---|---|---|
| 2,247,961 | 7/1941 | Mulvey | 2/2 |
| 2,481,291 | 9/1949 | Coleman | 2/2 |
| 2,851,390 | 9/1958 | Chavannes | 428/166 |
| 2,917,051 | 12/1959 | White | 2/267 |
| 3,185,362 | 5/1965 | Wakefield | 2/2 |
| 3,446,880 | 5/1969 | Enicks | 2/2 |
| 3,550,159 | 12/1970 | Alarco | 2/2 |
| 3,577,305 | 5/1971 | Hines et al. | 428/178 |
| 3,771,170 | 11/1973 | Leon | 2/2 |
| 3,872,511 | 3/1975 | Nichols | 2/413 |
| 4,185,327 | 1/1980 | Markve | 428/178 |
| 4,538,301 | 9/1985 | Sawatzki | 2/2 |
| 4,547,919 | 10/1985 | Wang | 2/413 |
| 4,602,384 | 7/1986 | Schneider | 2/2 |
| 4,700,403 | 10/1987 | Vacanti | 2/267 |
| 4,737,994 | 4/1988 | Galton | 2/2 |
| 4,807,301 | 2/1989 | Ferber | 2/267 |
| 4,884,295 | 12/1989 | Cox | 2/2 |

FOREIGN PATENT DOCUMENTS

| | | | |
|---|---|---|---|
| 63435 | 8/1913 | Austria | 2/2 |
| 0153082 | 8/1985 | European Pat. Off. | 2/2 |
| 0351147 | 1/1990 | European Pat. Off. | 2/267 |
| 2703538 | 8/1977 | Fed. Rep. of Germany | 2/2 |
| 3530397 | 3/1987 | Fed. Rep. of Germany | 2/2 |

*Primary Examiner*—Werner H. Schroeder
*Assistant Examiner*—Gloria Hale
*Attorney, Agent, or Firm*—R. Neil Sudol; Henry D. Coleman

[57] ABSTRACT

A protective device for reducing incidence of injury from falls comprises a sheet of flexible polymeric material provided with an array of fluid filled chambers and releasable fasteners such as VELCRO strips at spaced apart locations on the sheet for enabling securing of the sheet to a person's hips. The releasable fasteners on the sheet may function to releasably fasten the sheet to a garment such as a coat or robe. The fluid filled bubbles of the sheet material are designed to maximize protection in the areas where enhanced impacts are expected to occur during falls.

25 Claims, 5 Drawing Sheets

PROTECTIVE DEVICE FOR REDUCING INJURY FROM FALLS

BACKGROUND OF THE INVENTION

This invention relates to a protective device for reducing the incidence of injuries due to falls.

The dangers of slippery, ice covered driveways and sidewalks and other surfaces are well known to most people from personal experience. The incidence of injuries from accidental falls is particularly acute among the aged. Many elderly suffer painful hip injuries each year, even from falls occurring within the premises of old age homes and other institutions.

Many studies have been undertaken in an effort to isolate the causes of falls among the elderly, particularly in the institutional settings devoted to their care. Despite the vast amount of research into the causes of injuries among the aged, little or nothing has been done to alleviate the problem, except for an active restraint system which is currently under development. That system entails the attachment of tracks to ceilings inside buildings which house the elderly. The patients in the health care institutions would be required to fasten, or have fastened to their persons, a tether extending to a car riding along the track.

Such a system clearly has many disadvantages. It would be inordinately unwieldy and expensive. Moreover, the users of the system would be greatly restricted in their ambulatory travels. Another disadvantage of such a system is that it appears to be inhumane and will contribute to demoralization of the elderly.

Another solution which is currently being investigated and developed is to provide each elderly citizen with an inflatable bag. Such a bag would be equipped with a motion detector or other monitor(s) which would sense that a fall is in progress. Upon detecting a fall, the sensor would activate a pressure source to rapidly expand the bag and thereby cushion the individual from the impact of the fall.

Such a solution, although not nearly as complex as the federal proposal, involves delicate sensor control and may be prone to failure. Moreover, the cost of such an inflatable bag device may be prohibitive to many elderly individuals.

OBJECT OF THE INVENTION

An object of the present invention is to provide a protective device for reducing the risk of injury from falls.

Another object of the present invention is to provide such a device which is simple to implement, easy to manufacture and inexpensive.

Another, more particular, object of the present invention is to provide such a device which is worn over endangered body parts and is easy to put on and take off.

A further particular object of the present invention is to provide such a protective device which can be worn over a person's clothing.

Yet another particular object of the present invention is to provide such a protective device which can be worn under a person's clothing.

SUMMARY OF THE INVENTION

A protective device for reducing incidence of injury from falls comprises, in accordance with the present invention, a sheet of flexible polymeric material provided with an array of fluid filled chambers and at least one attachment component for temporarily securing the sheet around a person's hips.

The attachment components preferably include releasable fasteners at spaced apart locations on the sheet for forming with a portion of the sheet a substantially circular closure. The releasable fasteners advantageously take the form of VELCRO strips, while the sheet is an annular sector which assumes a frustoconical shape upon fastening of the releasable fasteners to form the substantially circular closure.

The attachment component may take the form of a belt type fastening element.

In another specific embodiment of the present invention, the attachment component or components include a garment and releasable fasteners on the sheet and the garment for releasably fastening the sheet to the garment. The fasteners are provided on an inside surface of the garment so that the sheet is attached in the manner of a liner to the garment at a hip region thereof.

Alternatively, the garment may be provided on an inside surface with a pocket for receiving the sheet.

Where the protective sheet is to be worn inside a coat or robe or other article of clothing, the sheet is preferably substantially rectangular and thus assumes a cylindrical shape during use.

In a more developed form of the invention, the sheet is provided with an extension of flexible polymeric material provided with an array of fluid filled chambers for covering the back of the person. Alternatively, or in addition, sheet may be formed with an extension of flexible polymeric material provided with an array of fluid filled chambers for covering a portion of a leg of the person, the protective device further comprising additional attachment elements for securing the extension around the person's leg.

Pursuant to another feature of the present invention, the fluid filled chambers have rupturable walls. More particularly, the chambers have walls of different strengths, for rupturing upon application of different magnitudes of force.

Accordingly, the fluid filled chambers in the sheet of polymeric material serve as a multitude of individual shock absorbers which dissipate kinetic energy in part through rupture.

Further dissipation of kinetic energy upon impact of a person's body with a hard surface may be provided by connecting a plurality of chambers in the protective sheet by small channels. Air is forced through the channels upon the application of pressure to the chambers' walls and acts in the manner of a dashpot, providing resistance to continued application of pressure.

When a chamber has been ruptured, whether due to a fall or a puncture or other inadvertent impact, the user may be alerted to the damage by an indicator mechanism. Such an indicator mechanism may take the form, for example, of a tint applied to the fluid filling the chambers. Upon rupture of a chamber and the escape of the enclosed fluid, the chamber changes color.

Pursuant to another feature of the present invention, the sheet has a plurality of layers, each of the layers comprising a web of flexible polymeric material provided with an array of fluid filled chambers. The fluid filled chambers of a first layer are, in one specific form of the invention, laterally staggered with respect to the fluid filled chambers of another layer.

The shock-absorbing effect of the bubbles or fluid filled chambers is also varied by providing the chambers with different sizes and/or different internal pressures in accordance with the expected magnitudes of forces experienced by different areas of the sheet in fall of the person.

A protective device in accordance with the present invention serves to reduce the risk of injury from falls. The device is simple to implement, easy to manufacture and inexpensive. When a person has a fall and ruptures one or more of the fluid filled chambers, the used device may be replaced by a new one.

A protective device in accordance with the present invention may be worn over or under clothing and may be taken off and used as a cushion or pillow, for example, at a sporting event or other event at which hard seats are the rule.

DETAILED DESCRIPTION

Figure 1:
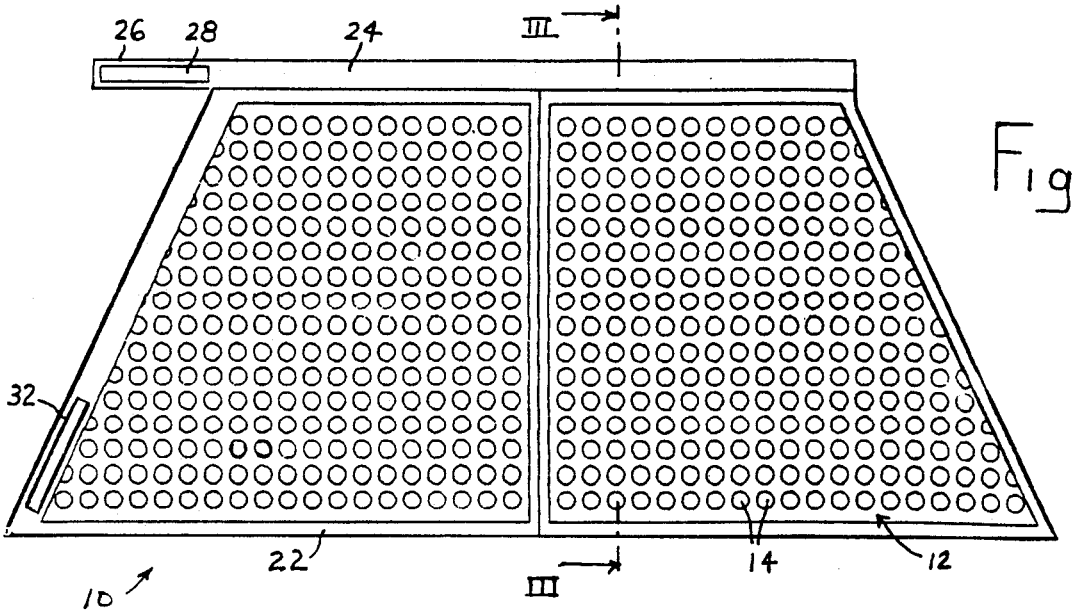
FIG. 1 is an elevational view of one side of a protective device in accordance with the present invention, in the form of a skirt.
Figure 2:
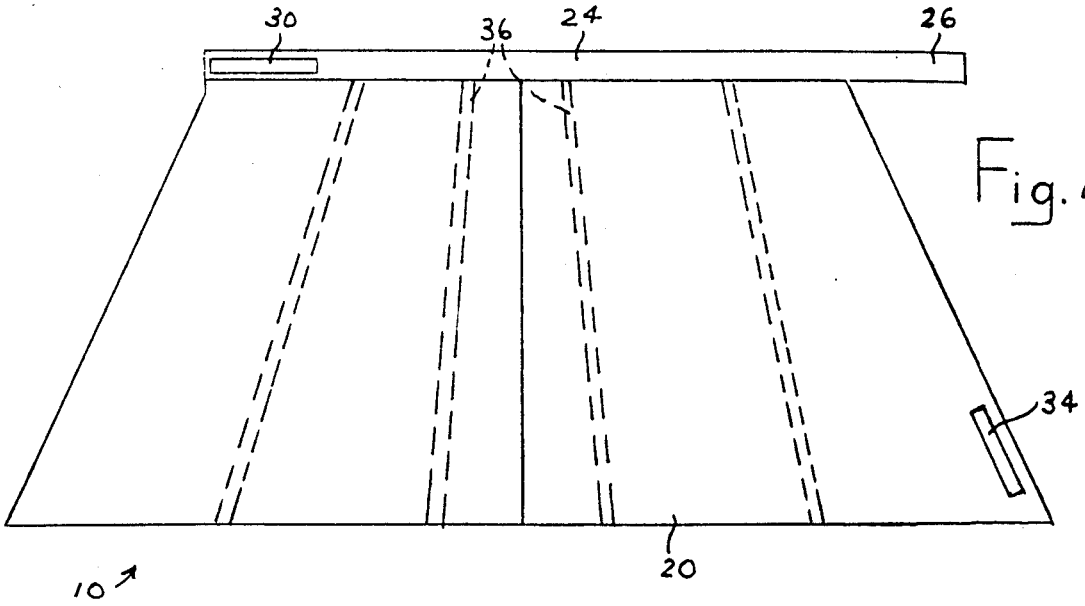
FIG. 2 is an elevational view of an opposite side of the protective skirt of FIG. 1.
Figure 3:
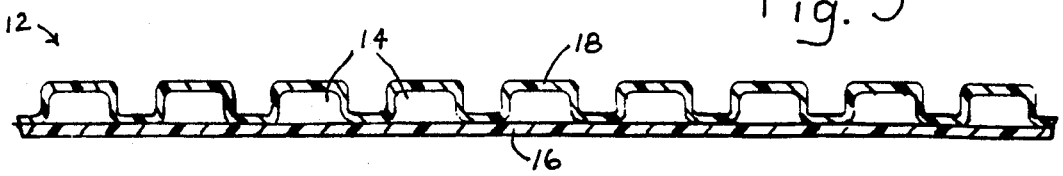
FIG. 3 is a partial cross-sectional view taken along line III—III in FIG. 1.

As illustrated in FIGS. 1-3, a fall protection device 10 in the form of a skirt comprises a layer of sheet material 12 provided with a rectangular array of cylindrical air filled bubbles or chambers 14. Sheet material 12 specifically comprises, as depicted in detail in FIG. 3, a backing web 16 of air-impermeable polymeric material such as polyethylene, polyvinyl chloride or polypropylene to which a bubble layer 18 is adhesively or ultrasonically bonded. On an outwardly facing side, shown in FIG. 2, fall protection device 10 is optionally provided with an ornamental or decorative fabric layer or cover 20 folded over along its periphery to form edge strips or hem areas 22. Along an upper side, fall protection device lo is provided with a belt strip 24 having a free end 26 to which a fastener element 28 is attached (see FIG. 1). Fastener element or component 28 preferably takes the form of one member of a pair of cooperating VELCRO strips, the other member 30 being attached to an opposite end of belt strip 24 from VELCRO fastener 28. Additional fastener elements 32 and 34 may be provided for enabling further securing of fall protection device 10 to a user. Fall protection device 10 may also carry flexible stays 36 for providing a conical form to the device and prevent folding during use.

A user who contemplates a walk over a treacherous surface, whether a slippery floor, an icy walkway, a root or rock strewn path, etc., first girdles herself or himself with fall protection device 10. The device is wrapped around the individual, outside of the person's clothing and is secured by fastener elements 28, 30, 32 and 34. Upon arriving at her or his destination, the wearer easily removes the fall protection device and places it nearby, ready for a return trip or a walk along another path. Fall protection device 10, when not being used for its intended injury abatement function, may nevertheless find use as a seating pad, for example, on hard or cold surfaces such as a sports stadium seat or a rock in a park.

Figure 4:
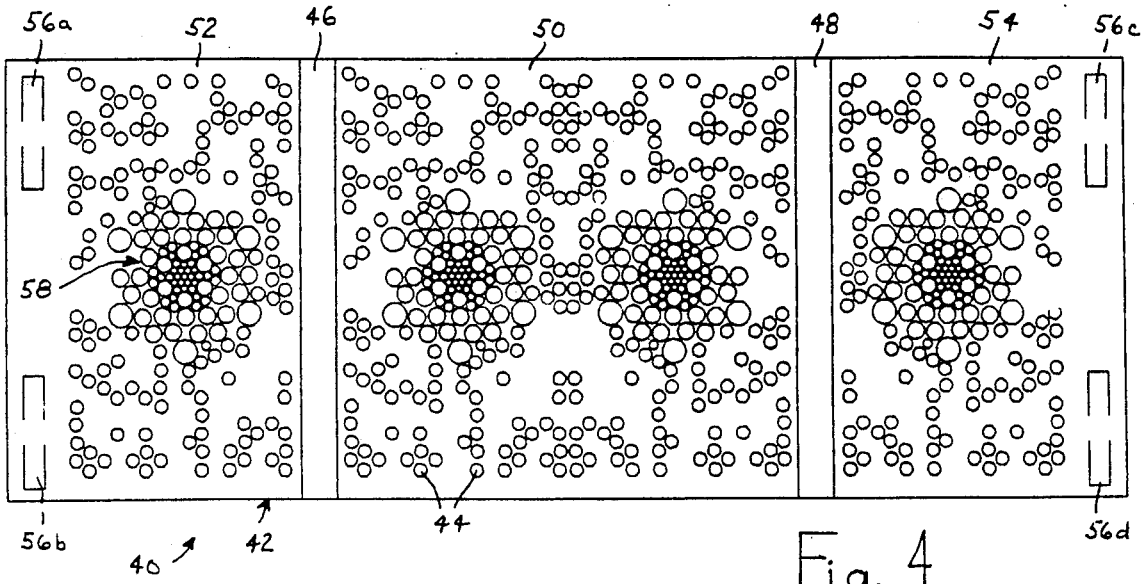
FIG. 4 is an elevational view of one side of a protective device in accordance with the present invention, in the form of a liner.

As illustrated in FIG. 4, another fall protection device 40 comprises a substantially rectangular sheet or web 42 having a multiplicity of gas filled bubbles or chambers 44. Sheet 42 is subdivided by a pair of hinge strips 46 and 48 into three subsections 50, 52 and 54, forming a back panel and two side panels of the device upon attachment in the manner of a liner thereof to the inside of a coat or robe (not illustrated). On a side facing the inner surface of the coat or robe, fall protection device 40 is provided with a plurality of VELCRO fastener elements **56*a*, 56*b*, 56*c* and 56*d***.

Fall protection liner 40 may be retained inside the coat or robe until replacement is indicated. Such replacement is recommended upon the loss of gas pressure from a plurality of chambers 44 all in a common area of the fall protection device.

As depicted in FIG. 4, chambers 44 have a varying size and distribution selected in accordance with the expected forces experienced by different areas of sheet 42. More particularly, those areas of sheet 42 juxtaposed to projecting parts of the pelvic bone are expected to encounter elevated magnitudes of force owing to the absence of natural padding at those areas. Accordingly, such areas of expected elevated forces are preferably designed to absorb and dissipate greater shocks. As shown in FIG. 4 at 58, a high density of relatively small bubbles or chambers 44 are believed better suited to accommodate the elevated force magnitudes. The small bubbles may be interspersed, however, with larger bubbles, whereby several stages of shock absorption and dissipation may be effectuated.

Fall protection device 40 may be alternatively attached to a coat or robe by being inserted into an inside or outside pocket (not depicted) provided on the garment in the hip region thereof.

Figure 5:
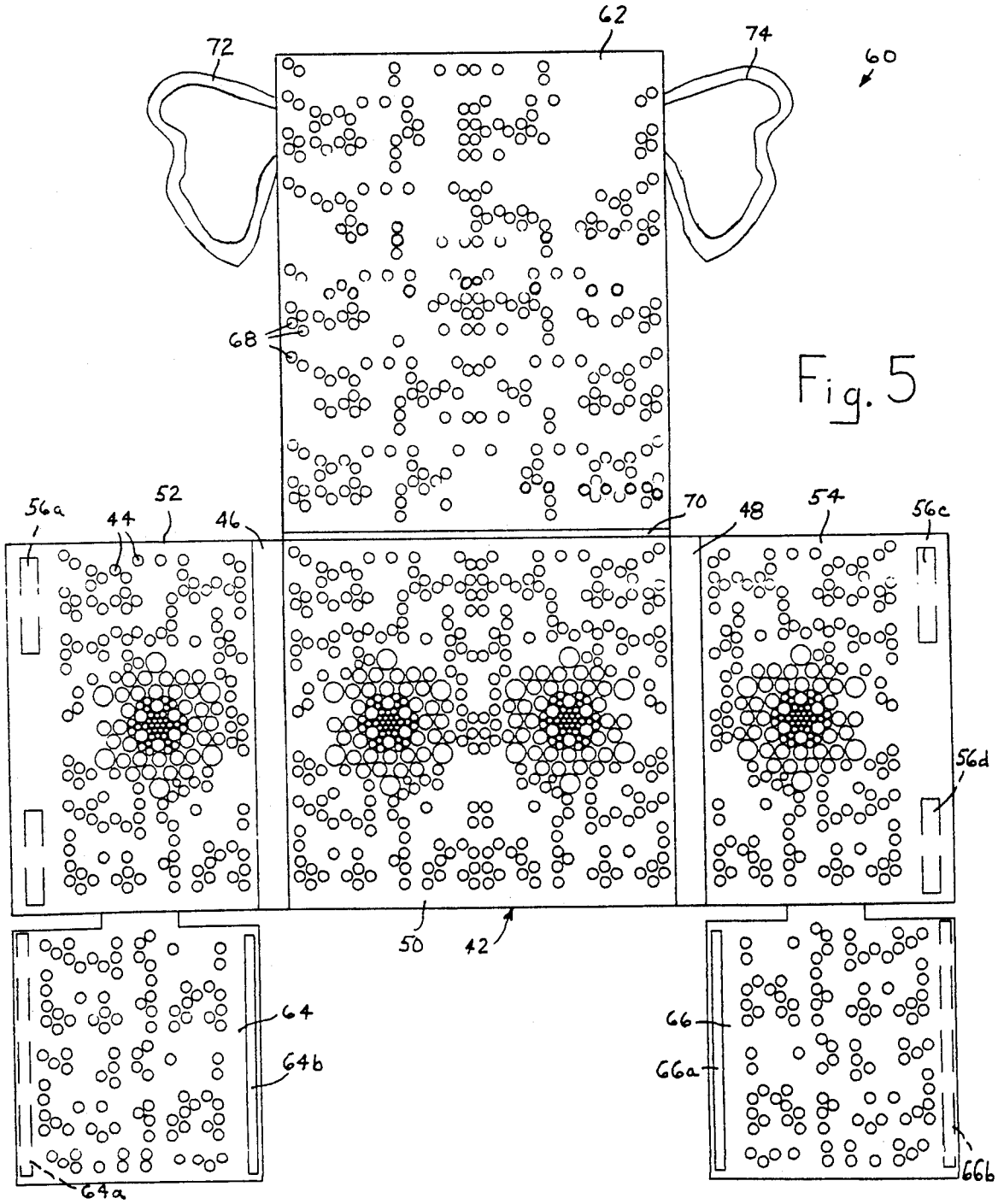
FIG. 5 is an elevational view of another protective liner-type device pursuant to the present invention.

As shown in FIG. 5, another fall protection device 60 comprises the same substantially rectangular sheet or web 42 as illustrated in FIG. 4. The above description of gas filled bubbles or chambers 44, hinge strips 46 and 48, back panel 50 and side panels 52 and 54, as well as VELCRO fastener elements **56*a*, 56*b*, 56*c* and 56*d*, applies to the corresponding designated components of fall protection device 60. Fall protection device 60 further comprises a back protection extension 62 and a pair of leg protection extensions 64 and 66. Like hip protection sheet 42, extensions 62, 64 and 66 each take the form of a rectangular sheet of polymeric material formed with a multiplicity of gas or fluid filled bubbles 68. Back protection extension or sheet 62 is connected to hip protection sheet 42 via a hinge strip 70 and is provided at an upper end, along opposite edges, with a pair of resilient loops 72 and 74 for securing the back extension to the user's arms. Leg protection extensions or sheets 64 and 66 are provided with VELCRO strips 64***a*, 64*b* and 66*a*, 66*b* for enabling a girthing of and attachment to a respective leg.

Figure 6:
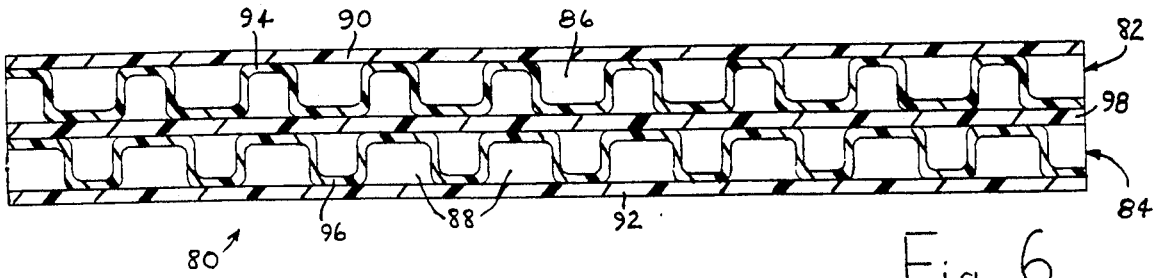
FIG. 6 is a partial cross-sectional view of a two-layered sheet material for use in a protective device in accordance with the present invention.

As depicted in FIG. 6, a sheet material 80 usable in any of the fall protection devices 10, 40 and 60 for achieving an enhanced protection from injury due to falls comprises two layers 82 and 84 of bubbles or fluid filled chambers 86 and 88. Each layer 82 and 84 is formed by a respective web 90 and 92 of polymeric material bonded to a respective bubble film 94 and 96. The two layers are separated by an additional web 98 to which bubble films 94 and 96 may be bonded by the application of adhesive, heat treatment or ultrasonic energy.

Figure 7:
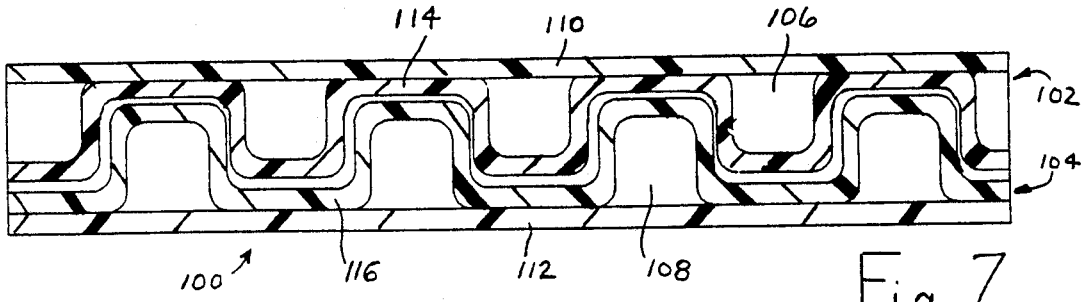
FIG. 7 is a partial cross-sectional view of another two-layered sheet material for use in a protective device in accordance with the present invention.
Figure 8:
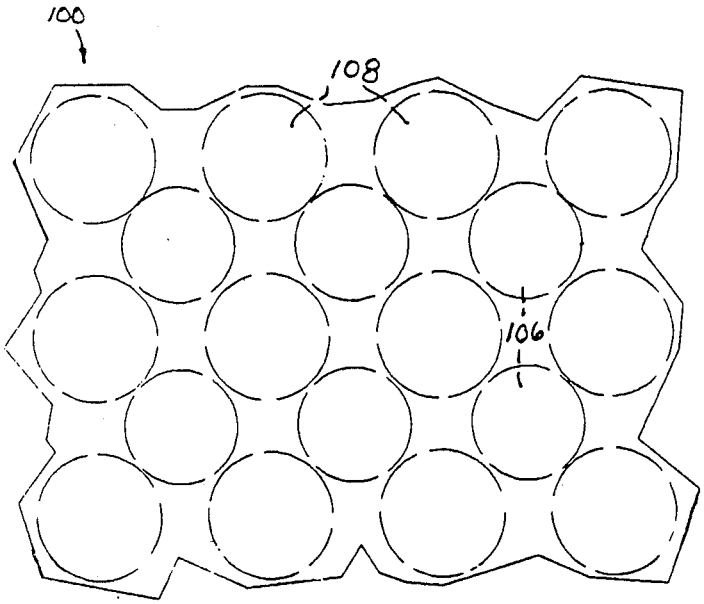
FIG. 8 is a partial top view of the sheet material shown in FIG. 7.

As illustrated in FIGS. 7 and 8, another enhanced protective sheet material 100 utilizable in a fall protection device in accordance with the present invention includes two layers 102 and 104 of bubbles or fluid filled chambers 106 and 108. Each layer 102 and 104 is formed by a respective web 110 and 112 of polymeric material bonded to a respective bubble film 114 and 116. Bubble layers 102 and 104 are staggered with respect to one another so that the chambers 106 of bubble layer 102 are disposed in the interstices between chambers 108 of bubble layer 104 and conversely chambers 108 of bubble layer 104 are disposed in the interstices between chambers 106 of bubble layer 102.

The two-layered sheet materials 80 and 100 of FIGS. 6–8 increase the effectiveness of fall protection devices in accordance with the present invention. The double layered sheet material increases the shock absorption and kinetic energy dissipation capability of the devices. Accordingly, the use of double layers is especially indicated in areas of hard impacts.

Figure 9:
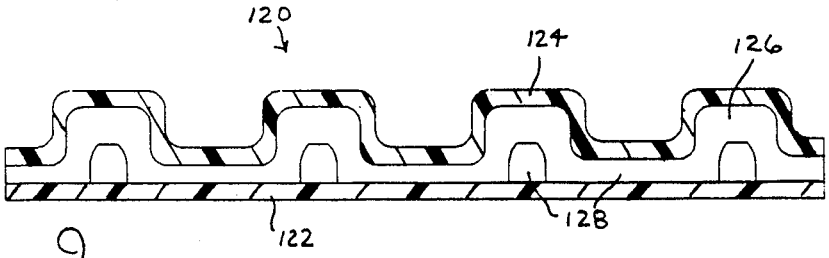
FIG. 9 is a partial cross-sectional view of another sheet material for use in a protective device in accordance with the present invention.
Figure 10:
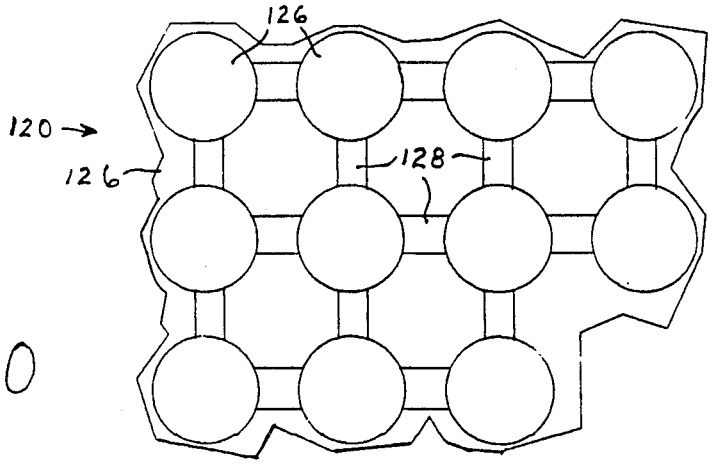
FIG. 10 is a partial top view of the sheet material shown in FIG. 9.

As illustrated in FIGS. 9 and 10, another sheet material 120 for use in fall protection device 10, 40 or 60 includes a first web 122 of polymeric material bonded to a second web 124 formed with a multiplicity of fluid filled bubbles or chambers 126. In contrast to the fluid filled chambers of FIGS. 6–8, chambers 126 are not discrete but are rather connected to one another via a network of channels 128. Upon the application of external pressure to sheet material 120, for example, in the course of a fall of a person wearing a fall protection device incorporating sheet material 120, fluid (e.g., air) is forced through channels 128, thereby providing resistance to the force and dissipating the force by the movement of the fluid.

Of course, it is not necessary for all of the chambers 126 to be connected to one another. Some chambers 126 may remain discrete, while others communicate with each other via channels 128.

Fluid filled chambers 14 (FIG. 1), 44 (FIGS. 4 and 5), 68 (FIG. 5), 86 and 88 (FIG. 6), 106 and 108 ( FIGS. 7 and 8) may be provided with rupturable walls. More particularly, the chambers have walls of different thicknesses and different strengths, for rupturing upon application of different magnitudes of force.

Although air is the preferred fluid with which the shock-absorbing chambers are filled, it is of course possible to use other gases or even liquids. More particularly, some or all of the pockets or chambers in areas of high impact expectancy may be filled with a liquid such as water, while other chambers, spaced from the higher danger zones, are preferably filled with air.

Tint may be applied to the fluid filling the chambers. Thus, upon rupture of a chamber and the escape of the enclosed fluid, the chamber changes color and thereby alerts a user or supervisory personnel to the lowered protection available from the particular fall protection device.

Figure 11:
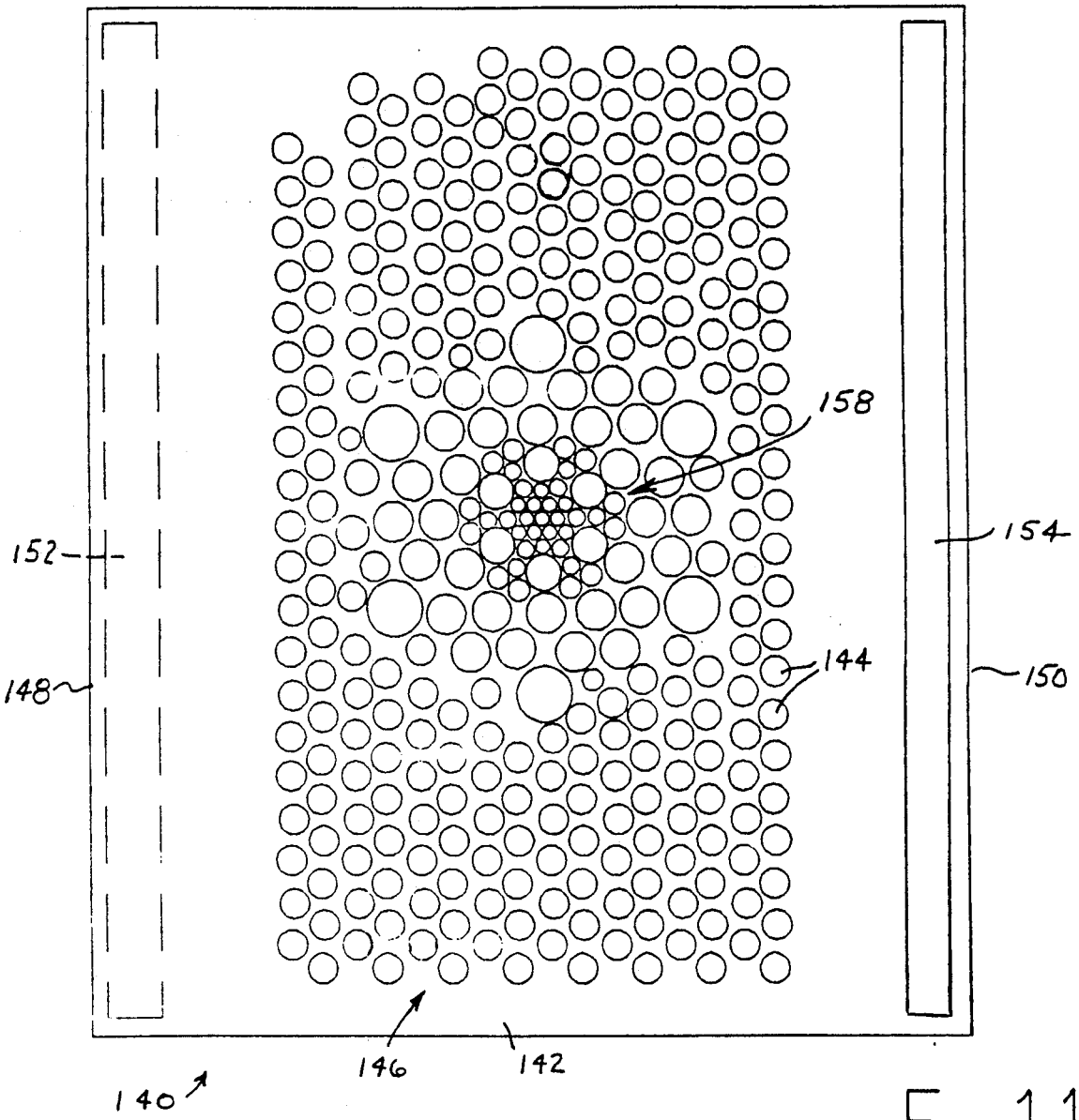
FIG. 11 is an elevational view of yet another protective device in accordance with the present invention, for protecting an elbow from injury in a fall.

As shown in FIGS. 11, a fall protection device 140 for the elbow includes a sheet 142 of polymeric material provided with an array of fluid filled bubbles or chambers 144. Sheet 142 is formed with bubbles 144 only in a central region 146 which is to be placed next to the elbow and the outer arm. Along opposite edges 148 and 150, sheet 142 is provided with a pair of VELCRO strips 152 and 154 for enabling attachment of the sheet about a person's arm and preferably outside any sleeve that the person is wearing on the arm. As discussed hereinabove with reference to FIG. 4, bubbles 144 have a varying size and distribution selected in accordance with the expected forces experienced by different areas of sheet 142. More particularly, that area of sheet 142 juxtaposed to the elbow is expected to encounter elevated magnitudes areas of sheet 142. More particularly, that area of sheet 142 juxtaposed to the elbow is expected to encounter elevated magnitudes of force owing to the absence of natural padding at that point. As shown in FIG. 11 at 158, a high density of relatively small bubbles or chambers 144 are believed better suited to accommodate the elevated force magnitudes. The small bubbles may be interspersed, however, with larger bubbles, whereby several stages of shock absorption and dissipation may be effectuated.

Figure 12:
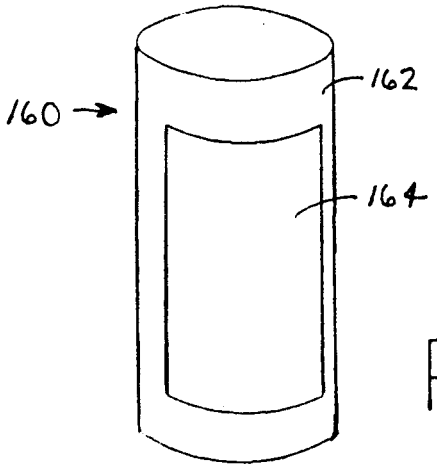
FIG. 12 is a schematic perspective view of a sleeve-type protective covering for an elbow, in accordance with the present invention.

As illustrated in FIG. 12, an elbow fall protection device 160 in accordance with the present invention may assume the form of a cylinder 162 provided along one side in an area 164 with fluid filled bubbles or chambers (not shown).

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are preferred by way of example to facilitate comprehension of the invention and should not be construed to limit the scope thereof.

What is claimed is:

1. A protective device for reducing incidence of injury from falls, comprising:

a sheet of flexible polymeric material provided with an array of fluid filled chambers; and attachment means for temporarily securing said sheet around a person's hips, said attachment means including exactly one tensile belt-type strip, said strip being disposed along one edge of said sheet, said attachment means further including releasable fasteners at spaced apart locations along said strip.

2. The device set forth in claim 1 wherein said releasable fasteners include hook and loop type fastener strips.

3. The device set forth in claim 1 wherein said sheet is an annular sector and assumes a frustoconical shape upon fastening of said releasable fasteners to one another.

4. The device set forth in claim 1 wherein said sheet is substantially rectangular.

5. The device set forth in claim 1 wherein said chambers have rupturable walls.

6. The device set forth in claim 1 wherein said sheet has a plurality of layers, each of said layers comprising a web of flexible polymeric material provided with an array of fluid filled chambers.

7. The device set forth in claim 6 wherein fluid filled chambers of a first of said layers are laterally staggered with respect to fluid filled chambers of another of said layers.

8. The device set forth in claim 1 wherein said chambers have different sizes in accordance with the expected magnitudes of forces experienced by different areas of said sheet in a fall of the person.

9. The device set forth in claim 1 wherein said chambers are filled with gas at different pressures in accordance with the expected magnitudes of forces experienced by different areas of said sheet in a fall of the person.

10. The device set forth in claim 1 wherein said chambers are filled with air.

11. The device set forth in claim 1 wherein said chambers are discrete.

12. The device set forth in claim 1 wherein a plurality of said chambers communicate with one another via channels.

13. The device set forth in claim 1 wherein said belt-type strip constitutes an edge portion of said sheet.

14. A protective device for reducing incidence of injury from falls, comprising:

a sheet of flexible polymeric material provided with an array of fluid filled chambers, said sheet being in the form of an annular sector; and attachment means for temporarily securing said sheet to a person so that said sheet assumes a frustoconical shape around the person's hips.

15. A protective device for reducing incidence of injury from falls, comprising:

a sheet of flexible polymeric material provided with an array of fluid filled chambers; and attachment means on said sheet for temporarily securing said sheet to a garment at a predetermined region of said garment so that said sheet is disposed around a corresponding part of a person upon donning of said garment by such person.

16. The device as set forth in claim 15 wherein said attachment means includes a fastener element on an inside surface of said garment so that said sheet is attached in the manner of a liner to said garment at the hip region thereof.

17. A protective assembly for reducing incidence of injury from falls, comprising:

a sheet of flexible polymeric material provided with an array of fluid filled chambers; and a garment provided with a pocket on an inside surface for receiving said sheet.

18. A protective device for reducing incidence of injury from falls, comprising:

a sheet of flexible polymeric material provided with an array of fluid filled chambers;

attachment means for temporarily securing said sheet around a person's hips; and an extension of flexible polymeric material connected to said sheet and provided with an array of fluid filled chambers for covering the back of the person.

19. A protective device for reducing incidence of injury from falls, comprising:

a sheet of flexible polymeric material provided with an array of fluid filled chambers;

attachment means for temporarily securing said sheet around a person's hips; and an extension of flexible polymeric material connected to said sheet and provided with an array of fluid filled chambers for covering a portion of a leg of the person, further comprising additional attachment means for securing said extension around the person's leg.

20. A protective device for reducing incidence of injury from falls, comprising:

a sheet of flexible polymer material provided with an array of fluid filled chambers, said chambers having walls of different strengths, whereby said chambers rupture upon application of different magnitudes of force; and attachment means for temporarily securing said sheet around a predetermined part of a person's anatomy.

21. A protective device for reducing incidence of injury from falls, comprising:

a sheet of flexible polymeric material provided with an array of rupturable fluid filled chambers;

means for indicating that any one of said chambers has ruptured; and attachment means for temporarily securing said sheet around a predetermined part of a person's anatomy.

22. The device set forth in claim 20 wherein said means for indicating includes a tint applied to the fluid filling said chambers.

23. A protective device for reducing incidence of injury from falls, comprising:

a sheet of flexible polymeric material provided with an array of fluid filled chambers; and attachment means for temporarily securing said sheet around a predetermined part of a person's anatomy, said chambers having different sizes in accordance with the expected magnitudes of forces experienced by different areas of said sheet in a fall of the person.

24. A protective device for reducing incidence of injury from falls, comprising:

a sheet of flexible polymeric material provided with an array of fluid filled chambers; and attachment means for temporarily securing said sheet around a predetermined part of a person's anatomy, said chambers being filled with gas at different pressures in accordance with the expected magnitudes of forces experienced by different areas of said sheet in a fall of the person.

25. A protective device for reducing incidence of injury from falls, comprising:

a sheet of flexible polymeric material provided with an array of fluid filled chambers, a plurality of said chambers communicating with one another via channels; and attachment means for temporarily securing said sheet around a predetermined part of a person's anatomy.

* * * * *